US008789394B2

(12) United States Patent
Tatsumi et al.

(10) Patent No.: US 8,789,394 B2
(45) Date of Patent: Jul. 29, 2014

(54) RESIN-COATED GLOVE

(75) Inventors: Kaoru Tatsumi, Tokyo (JP); Hideo Nakamura, Tokyo (JP); Shuu Izumi, Tokyo (JP); Akira Hirai, Tokyo (JP)

(73) Assignee: Du Pont-Toray Company, Ltd., Tokyo (JP)

( * ) Notice: Subject to any disclaimer, the term of this patent is extended or adjusted under 35 U.S.C. 154(b) by 0 days.

(21) Appl. No.: 13/996,905

(22) PCT Filed: Dec. 19, 2011

(86) PCT No.: PCT/JP2011/079354
§ 371 (c)(1),
(2), (4) Date: Aug. 20, 2013

(87) PCT Pub. No.: WO2012/086584
PCT Pub. Date: Jun. 28, 2012

(65) Prior Publication Data

US 2013/0319055 A1 Dec. 5, 2013

(30) Foreign Application Priority Data

Dec. 22, 2010 (JP) ..... 2010-286510

(51) Int. Cl.
*D04B 7/34* (2006.01)

(52) U.S. Cl.
USPC ..... 66/174; 2/167

(58) Field of Classification Search
USPC ..... 66/174, 175, 202; 57/210, 211, 224, 57/225, 226, 227, 228, 236; 2/159, 167
See application file for complete search history.

(56) References Cited

U.S. PATENT DOCUMENTS 3,038,295 A * 6/1962 Humphreys ..... 57/225
3,287,892 A * 11/1966 Rapoza ..... 57/225

(Continued)

FOREIGN PATENT DOCUMENTS

JP 2003-201636 A 7/2003
JP 2004-250825 A 9/2004
JP 2005-256212 A 9/2005
JP 2008/274495 A 11/2008

OTHER PUBLICATIONS

International Search Report mailed Feb. 7, 2012, from the Japanese Patent Office in related Japanese Patent Application No. PCT/JP2011/079354, with English translation (4 pages).

(Continued)

*Primary Examiner* — Danny Worrell
(74) *Attorney, Agent, or Firm* — Osha Liang LLP

(57) ABSTRACT

Provided is a glove which has good adhesiveness to a rubber or resin coating material and excellent durability and further fits a hand well enabling good work efficiency. The glove is knitted from a covered yarn obtained by winding a sheath yarn around a core yarn and at least a part of the surface thereof is coated with a rubber or resin coating material, wherein the sheath yarn is a crimped yarn made of a high strength fiber having, as a property of a raw yarn, a tensile strength of 1.75 N/tex or more as measured according to JIS L 1013 8.5, and the crimped yarn simultaneously satisfies the following (1) to (3): (1) a degree of bulkiness of 40 $cm^3/g$ or more as measured according to JIS L 1013 8.16 A method after hot water treatment at 90° C. for 20 minutes, (2) a bulk compression modulus of 80% or more as measured according to the same method, and (3) a shrinkage/elongation ratio of 20% or more as measured according to JIS L 1013 8.11 A method.

12 Claims, 2 Drawing Sheets

(56) References Cited

U.S. PATENT DOCUMENTS

| | | | | |
|---|---|---|---|---|
| 6,701,703 | B2 * | 3/2004 | Patrick | 57/229 |
| 2003/0074879 | A1 * | 4/2003 | Patrick | 57/229 |
| 2003/0205041 | A1 * | 11/2003 | Baker, Jr. | 57/224 |
| 2008/0040906 | A1 * | 2/2008 | Earley et al. | 28/144 |
| 2008/0289312 | A1 * | 11/2008 | Takada | 57/232 |
| 2013/0319055 | A1 * | 12/2013 | Tatsumi et al. | 66/174 |

OTHER PUBLICATIONS

PCT International Preliminary Report on Patentability (IPRP) and Written Opinion issued Jun. 25, 2013, by the International Bureau of WIPO, in related International Application No. PCT/JP2011/079354, with an English translation (8 pages).

* cited by examiner

RESIN-COATED GLOVE

TECHNICAL FIELD

The present invention relates to gloves coated with a rubber or resin coating material.

BACKGROUND ART

General thermoplastic synthetic fibers such as nylon or polyester fibers commonly used for clothing and industrial materials melt at about 250° C., have a limiting oxygen index of about 20, and thus burn well in the air. Accordingly, these general thermoplastic synthetic fibers are not considered suitable as protective fiber raw materials for clothing products used in a situation where they have a high risk of being exposed to flames and high temperature, including firefighting clothing, racing suits for motor races, workwear for steel industry workers or welders, and gloves.

Heat-resistant high functional filament yarns, such as aramid fibers, wholly aromatic polyester fibers, and polyparaphenylene benzobisoxazole fibers, do not melt at about 250° C. and has a decomposition temperature as high as 400° C. or more. These yarns have a limiting oxygen index of about 25 or more, and burn in the air when a flame, which is a heat source, is brought close thereto but the inflammation does not continue when the flame is moved away.

Thus, heat-resistant high functional filament yarns are materials having excellent heat resistance and flame retardancy. For this reason, for example, aramid fibers, which are heat-resistant high functional filament yarns, are preferably used for clothing products worn in a situation where they have a high risk of being exposed to flames and high temperature, for example, in the form of protective clothing such as firefighting clothing, racing suits for motor races, workwear for steel industry workers or welders, and gloves. Of these yarns, para-aramid fibers having both heat resistance and high strength properties are used for sportswear, workwear, ropes, tire cords, and the like, which require tear strength and heat resistance, and also used for wound protection work gloves and the like because of their knife-cutting resistance.

As para-aramid fibers, polyparaphenylene terephthalamide (PPTA) fibers are well known, and methods for producing PPTA fibers are disclosed in, for example, U.S. Pat. No. 3,767,756 and Japanese Patent Publication No. 56-128312. On the other hand, meta-aramid fibers, unlike para-aramid fibers, do not have cut wound resistance or high tensile strength, but are used for firefighting clothing, heat insulation filters, heat-resistant dust filters, electrical insulation materials, and the like, because of their heat-resistance properties.

Conventionally, when manufacturing clothing products using these heat-resistant high functional filament yarns, these fibers were only used in the form of non-stretch filament yarns or spun yarns. However, when non-stretch yarns such as filament yarns or spun yarns are processed into a fabric to produce clothing products such as firefighting clothing, racing suits or workwear, the obtained clothing products have poor stretchiness and poses the disadvantages of being uncomfortable and making it difficult to move when the clothing products are worn. Conventional work gloves similarly made of non-stretch yarns also had a sense of ill-fitting, causing work efficiency to be reduced.

Considering the demand in the related markets, many studies and proposals on a method for imparting a crimp to heat-resistant high functional filament yarns have been conducted. For example, known methods include a method in which a low modulus fiber is mixed into a high modulus fiber such as a para-aramid fiber and a crimp is imparted by a stuffing box method (Patent Literature 1), a method in which an aramid fiber is subjected to false twist crimping using a non-contact heater heated to a decomposition initiation temperature or more and less than a decomposition temperature thereof (390° C. or more and less than 460° C. for meta-aramid fibers), followed by relaxation heat treatment to impart a crimp (Patent Literature 2), and a method in which a heat-resistant high functional fiber yarn such as para-aramid fibers is twisted and then heat-set by hydrothermal treatment at 130 to 250° C. or dry heat treatment at 140 to 390° C. and subsequently untwisted (Patent Literature 3).

It is also reported that protective gloves or the like having excellent burn resistance, heat resistance and stretchability are obtained by composing a woven or knitted fabric using a covered yarn prepared by winding a spun yarn or a crimped yarn of a para-aramid fiber around a stretchable elastic fiber (Patent Literatures 4 to 6).

Patent Literatures 5 and 6 disclose a crimped yarn of a para-aramid fiber having a stretch recovery ratio ranging from 4 to 80%. Specifically, Patent Literature 5 discloses that a twisted yarn is subjected to high temperature high pressure water vapor or high temperature high pressure water treatment at 130 to 250° C. (so-called wet-heat treatment) or by dry heat treatment wherein the yarn is heated in the air, to set the twist, and the twisted yarn with the twist fixed is untwisted in the opposite direction to the above direction to obtain a crimped yarn. Accordingly, in Example 1, a twisted para-aramid fiber is treated with saturated water vapor at 200° C. for 15 minutes to set the twist and subsequently untwisted to obtain a crimped yarn having a shrinkage/elongation ratio of 29.0% and a stretch recovery ratio of 8.2%, and in Example 4, a twisted para-aramid fiber is subjected to dry heat treatment at 100° C. for 30 minutes to set the twist and subsequently untwisted to obtain a crimped yarn having a shrinkage/elongation ratio of 29.0% and a stretch recovery ratio of 8.0%.

Patent Literature 6 discloses that a glove which was knitted using a covered yarn obtained by winding the crimped yarn of a para-aramid fiber obtained in Example 1 of Patent Literature 5 around an elastic fiber and coated with a urethane resin was stretchy, fitted a hand well and enhanced workability.

The protective gloves and the like have at least a part of the back and palm sides of the glove coated with a rubber or resin coating material to impart reinforcement and waterproofing properties; however, a problem of the protective gloves obtained in Patent Literature 6 is that they have poor adhesiveness between the coating material and the glove material, which causes the coating material to peel off while using the gloves, thus failing to provide durable gloves.

Another problem is that when the amount of the coating material adhered is increased for the purpose of enhancing the adhesiveness and durability of the coating, the gloves do not fit well and adversely affect workability when worn and the degree of freedom of monofilaments is reduced because the coating material firmly binds the high strength fiber, causing reduced cut wound resistance.

CITATION LIST

Patent Literature

Patent Literature 1:
Japanese Patent Laid-Open No. 1-192839
Patent Literature 2:
Japanese Patent Laid-Open No. 6-280120
Patent Literature 3:
Japanese Patent Laid-Open No. 2001-248027

Patent Literature 4:
Japanese Patent Laid-Open No. 2004-011060
Patent Literature 5:
Japanese Patent Laid-Open No. 2003-193345
Patent Literature 6:
Japanese Patent Laid-Open No. 2003-193314

SUMMARY OF THE INVENTION

Problems that the Invention is to Solve

Considering such a conventional art background, an object of the present invention is to provide a glove which has good adhesiveness to a rubber or resin coating material and excellent durability and further fits a hand well enabling good work efficiency.

Means for Solving the Problems

To solve such a problem, the present invention employs the following means. More specifically, the present invention is as follows.

1) A glove knitted from a covered yarn obtained by winding around a core yarn a sheath yarn made of a high strength fiber having, as a property of a raw yarn, a tensile strength of 1.75 N/tex or more as measured according to JIS L 1013 8.5, and coated with a rubber or resin coating material on at least a part of the surface thereof, wherein the sheath yarn is a crimped yarn having bulkiness and stretchiness which simultaneously satisfy the following (1) to (3):

(1) a degree of bulkiness of 40 $cm^3/g$ or more,
(2) a bulk compression modulus of 80% or more, and
(3) a shrinkage/elongation ratio of 20% or more.

2) The glove according to the above 1), wherein the degree of bulkiness is 40 to 80 $cm^3/g$.
3) The glove according to the above 1) or 2), wherein the bulk compression modulus is 80 to 95%.
4) The glove according to any of the above 1) to 3), wherein the shrinkage/elongation ratio is 20 to 70%.
5) The glove according to any of the above 1) to 4), wherein the crimped yarn has a strength retention of 25% or more.
6) The glove according to any of the above 1) to 5), wherein the sheath yarn is a crimped yarn of a para-aramid fiber.
7) The glove according to the above 6), wherein the crimped yarn of a para-aramid fiber is obtained by twisting the fiber, then heat-setting the twisted fiber by dry heat treatment under a heater temperature of 470 to 550° C., and subsequently untwisting the twist.
8) The glove according to any of the above 1) to 7), wherein the core yarn is an elastic fiber.
9) The glove according to any of the above 1) to 8), wherein the covered yarn has a draft ratio of the core yarn of 1.5 to 5.0 and has a twist factor ($K_2$) for covering of the sheath yarn of 500 to 5,000.

$$K_2=T\times D^{1/2}$$

wherein T represents a number of twists (twists/m) for the covering and D represents fineness (tex).

10) The glove according to any of the above 1) to 9), wherein the coating material is a polyurethane resin.
11) The glove according to the above 10), wherein the polyurethane resin is formed by a wet film forming method.

Advantage of the Invention

The glove of the present invention is knitted from a covered yarn using, as a sheath yarn, a conventionally unavailable crimped yarn having both bulkiness and stretchiness, and is thus voluminous and has excellent adhesiveness to the coating material because a rubber or resin coating material suitably goes into the gaps of the sheath yarn and is fixed, hardly causing the coating material to peel off when used over an extended period of time. The glove fits well and provides good workability when worn. The problem of reduced cut wound resistance caused by a reduced degree of freedom of the monofilaments is also hard to arise.

EMBODIMENTS OF IMPLEMENTING THE INVENTION

Figure 1:
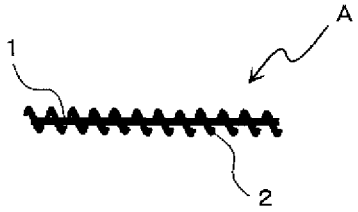
FIG. 1 is a schematic side view showing an example of the covered yarn used in the present invention.

The glove according to the present invention will be described below in detail.

Examples of the core yarn in the covered yarn used for knitting the glove of the present invention include, in addition to general fibers such as polyester fibers, polyamide fibers, rayon fibers and polyvinyl alcohol fibers, heat-resistant high strength fibers such as meta-aramid fibers, para-aramid fibers, wholly aromatic polyester fibers, polyparaphenylene benzobisoxazole fibers, and polyketone fibers; metal fibers, glass fibers, ceramic fibers and elastic fibers. These fibers may be used singly, or two or more may be used in combination.

Of the above fibers, the stretchy elastic fibers are preferably used as the core yarn in the covered yarn in respect of imparting the covered yarn with stretchiness. As the elastic fiber, polyurethane elastic fibers having a high stretchiness are preferable. The cross sectional shape of such a polyurethane elastic fiber is not particularly limited and may be circular or flat, and the fiber thereof may be a monofilament or welded multifilament.

The fineness of the elastic fiber ranges preferably from 11 to 940 dtex, and more preferably from 22 to 350 dtex. When the fineness is 11 dtex or more, the yarn does not break during the steps of covering and knitting the glove and also the glove fits well when worn, whereas when the fineness is 940 dtex or less, the yarn always satisfies the number of gauges of a glove knitting machine. It is also preferable that a fracture elongation be 300% or more, and a fracture elongation below 300% may fail to obtain sufficient stretchiness when forming the glove.

The sheath yarn in the covered yarn used for knitting the glove of the present invention is a crimped yarn obtained by subjecting a fiber having, as a property of a raw yarn, a tensile strength of 1.75 N/tex or more as measured according to JIS L 1013 8.5 to crimping. A tensile strength below 1.75 N/tex fails to impart high flexibility and abrasion resistance to the covered yarn, making it unsuitable for knitting the protective glove. It is preferably about 1.75 to 3.5 N/tex.

Preferable examples of the material composing the above sheath yarn include, in light of tensile strength and abrasion resistance, heat-resistant high strength fibers such as para-aramid fibers, wholly aromatic polyester fibers, polyparaphenylene benzobisoxazole fibers, polyketone fibers, polyamide-imide fibers, and LCP (liquid crystalline polymer) fibers. Of these materials, para-aramid fibers are preferable in respect of good heat resistance, flame retardancy as well as high strength properties and cut wound resistance.

The para-aramid fibers used herein refer to polyparaphenylene terephthalamide fiber (trade name "Kevlar," manufactured by Du Pont-Toray Co., Ltd.) and copolyparaphenylene-3,4'-diphenyl ether terephthalamide fiber (trade name "Technora," manufactured by Teijin Techno Products Ltd.) and the like. Of these, the polyparaphenylene terephthalamide fiber is preferable due to high strength and high modulus as well as good cut wound resistance and heat resistance.

Examples of the wholly aromatic polyester fiber include trade name "Vectran," manufactured by Kuraray Co., Ltd., and examples of the polyparaphenylene benzobisoxazole fiber include trade name "Zylon," manufactured by Toyobo Co., Ltd. Examples of the polyketone fiber include trade name "Cyberlon," manufactured by Asahi Kasei Fibers Corporation, polyether ketone (PEK) fibers, polyether ketone ketone (PEKK) fibers and polyether ether ketone (PEEK) fibers. Examples of the polyamide-imide fiber include trade name "Kermel" manufactured by Rhone-Poulene S. A.

The sheath yarn used in the covered yarn for knitting the glove of the present invention is a crimped yarn which is obtained by crimping a high strength fiber where a raw yarn has the above tensile strength property and simultaneously satisfies the following (1) to (3) properties. Hot water treatment at 90° C. is carried out for 20 minutes to fix the twist.

(1) The degree of bulkiness is 40 $cm^3/g$ or more as measured according to the JIS L 1013 8.16 A method after the hot water treatment at 90° C. for 20 minutes.
(2) The bulk compression modulus is 80% or more as measured according to the JIS L 1013 8.16 A method after the hot water treatment at 90° C. for 20 minutes.
(3) The shrinkage/elongation ratio is 20% or more as measured according to the JIS L 1013 8.11 A method.

The sheath yarn composing the covered yarn simultaneously satisfies the above (1) to (3) conditions, and hence the voluminous glove can be obtained having good adhesiveness between the fiber and coating material, causing the coating material to hardly peel off when used for an extended period of time. When the sheath yarn does not satisfy either one of the above (1) and (2), the coating material cannot suitably go into the fiber gaps composing the glove, causing insufficient peel strength between the coating layer and the fiber layer of the glove. When the sheath yarn does not satisfy the above (3) shrinkage/elongation ratio, the glove has a poor sense of fitting. The degree of bulkiness of the above (1) is desirably 5% or more, preferably 15% or more higher than the value before the 90° C. hot water treatment, and when the sheath yarn satisfies this conditions, the glove having far better volume and sense of fitting can be obtained.

For the yarn composed of high strength fibers, filament yarns which hardly produce fluff and dust are used.

In the present invention, the crimped yarn to be used as the sheath yarn is produced by carrying out a twisting step of twisting yarns composed of high strength fibers such as aramid fibers, subsequently a heat treatment without using high temperature high pressure water vapor or high temperature high pressure water, i.e., a dry heat treatment step, and further an untwisting step of untwisting the above twist. Examples of the production method include a continuous false twisting method and a batch (non-continuous) production method. More preferable method is the continuous false twisting method in respects of the bulkiness of a crimped yarn, i.e., obtaining a crimped yarn having a high degree of bulkiness and a high bulk compression modulus, as well as spreading out the fibers of a crimped yarn, i.e., good untwisted condition.

More specifically, the production method employing the continuous false twisting method will be described.

In the false twisting method, a yarn pulled out of a yarn feed cheese by feed rollers is wound up by a take-up bobbin via a heater, a false twist apparatus and a take-up roller. In the false twist apparatus, for example, a spinner may be mounted on a false twist spindle, the yarn is wound around a pin of the spinner and set, and when the spindle is turned, the yarn between the feed rollers and the false twist spindle is, for example, S-twisted (the twisting step), the yarn to which the twists are applied is thermoset using a heater (dry heat treatment), and the twist is untwisted by, for example, applying Z-twist, which is the opposite direction to the first twist, between the false twist spindle and the take-up roller (the untwisting step), thereby producing a crimped yarn. A cooling zone lies between the false twist apparatus and the take-up roller, and air-cooling is preferable. For the method for applying a false twist, in addition to the above described false twist spindle, a method is employed in which a yarn is allowed to contact the inner wall of a cylinder or the outer rim of a disk revolving in a high speed or the surface of a belt operated in a high speed to give a false twist by the friction, i.e., a nip belt or a friction disc and the like.

In the above false twisting method, as for the number of false twists by the false twist spindle, it is suitable that the value of the twist factor ($K_1$) represented by the expression (1) below be about 5,000 to 11,000, and preferably about 6,000 to 9,000, in order to suitably crimp a yarn and prevent the fiber from being cut by excessive twists.

$$K_1 = t \times D^{1/2} \quad (1)$$

wherein t represents the number of false twists (twists/m) and D represents fineness (tex).

When the twisting is applied using the false twist spindle, a spinner equipped with 1 pin, 2 pins or 4 pins may be used.

The temperature condition for the thermosetting during the dry heat treatment is suitably a high temperature treatment so as the crimped yarn to have the intended bulkiness and stretchiness, and is preferably close to the decomposition initiation temperature of a raw material fiber. The preferable temperature condition varies depending on the raw material fiber, but an atmospheric temperature of the inside the heater through which the yarn passes, i.e., a heater temperature, is about 400 to 700° C., and more preferably 500 to 600° C. When para-aramid fibers are used, the temperature is preferably 470 to 550° C.

The heater used in the thy heat treatment may be a contact heater or a non-contact heater, and may be carried out by a known means. The heating time cannot be determined definitely since it varies depending on the type of fiber, the thickness of yarn or heating temperature, but is desirable to be typically about 0.005 to 1 second. It is more preferably about 0.01 to 0.1 seconds.

The dry heat treatment may be carried out under elevated pressure, reduced pressure or atmospheric pressure, but typically the continuous false twisting is preferably carried out under atmospheric pressure.

When producing a crimped yarn of a para-aramid fiber in the above production method by the false twisting method, it is desirable to use the para-aramid fiber having, before the false twisting, a water content of preferably 20% or less, more preferably 15% or less, and particularly preferably 1 to 10%. In this instance, D in the above expression (1) represents fineness (tex) containing moisture. When a water content before twisting exceeds 20%, the heat during the dry heat treatment is not efficiently transmitted to the yarn, failing to attain the thermosetting effects whereby a good crimped yarn is hardly made, whereas when a water content before twisting is below 1%, the yarn is likely to be fibrillated by the rubs of a yarn path guide or the like.

In the false twisting method, it is suitable that the crimped yarn have a strength retention of 25% or more, preferably 30% or more, and more preferably 40% or more, as an indication of the high strength fibers being free of reduced strength. The strength retention is calculated by the following expression.

Strength retention(%)={strength of crimped yarn(*N*/tex)/raw yarn strength(*N*/tex) of high strength fiber}×100

The thus produced crimped yarn of high strength fibers has a degree of bulkiness of 40 $cm^3/g$ or more, preferably 40 to 80 $cm^3/g$, and more preferably 45 to 70 $cm^3/g$, as measured according to the JIS L 1013 8.16 A method after the obtained crimped yarn is subjected to the hot water treatment at 90° C. for 20 minutes. The bulk compression modulus, as measured according to the same method, is 80% or more, preferably 80 to 95%, and more preferably 85 to 90%.

When the above degree of bulkiness is below 40 $cm^3/g$ and/or when the above bulk compression modulus is below 80%, the adhesiveness to the coating material is reduced. Conversely, when the degree of bulkiness exceeds 80 $cm^3/g$ and/or when the bulk compression modulus exceeds 95%, the coating material excessively goes into the fiber gaps and may reduce a sense of fitting and cut wound resistance of the glove. Particularly in the present invention, the untwisted condition of the false twisted yarn becomes good by increasing the thermosetting temperature at the time of producing the crimped yarn and the bulk compression modulus of the crimped yarn enhances, whereby the resin comes into the gaps of fiber and enhances the adhesiveness.

The crimped yarn of high strength fibers has a shrinkage/elongation ratio of 20% or more, and more preferably 20 to 70%, as measured according to JIS L 1013 8.11 A method. When the shrinkage/elongation ratio is below 20%, the coating material has poor adhesiveness when the glove surface is coated with a rubber or a resin, whereas the ratio exceeds 70%, the crimped yarn has poor compatibility with the core yarn, particularly with the elastic fiber and thus causes the covered yarn to have a bumpy appearance, which is likely to cause a rubber or resin coating applied to the glove surface to lift, thereby giving a glove with poor workability.

The fineness and the number of filaments of the sheath yarn composed of such a high strength fibers may suitably be selected according to the purpose of use in consideration of surface appearance, heat resistance, stretchiness, texture, and the like. The fineness of sheath yarn preferably ranges, according to the purpose of use, from 20 to 1,600 dtex.

The monofilament fineness of the sheath yarn ranges preferably, according to the purpose of use, from 0.1 to 10 dtex, more preferably 0.4 to 5 dtex. When the fineness is below 0.1 dtex, the yarn production efficiency becomes low thus raising the costs, whereas when the fineness exceeds 10 dtex, the sheath yarn has high rigidity being unsuitable for the glove which is required to be flexible.

The covered yarn used in the present invention may be those in which the sheath yarn covers around the core yarn in a one-ply manner in light of obtaining good stretchiness, or may be those in which the sheath yarn covers around the core yarn in a two-ply manner in light of obtaining good covering properties. In this two-ply covered yarn, the first covering yarn is called a bottom twist yarn and the second covering yarn is called a top twist yarn. When the core yarn is covered in a two-ply manner, the top twist yarn preferably covers in the opposite twist direction to the twist direction of the covering of the bottom twist yarn, in order to cancel the torque. FIG. 1 is a schematic side view of the one-ply covered yarn shown as an example of the covered yarn. The covered yarn A has a core yarn 1 covered with a sheath yarn 2 wound therearound in a one-ply manner.

Figure 2:
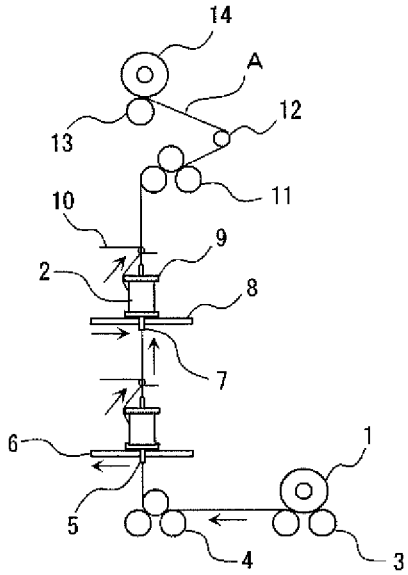
FIG. 2 is a schematic diagram showing an example of a method for producing the covered yarn used in the present invention.

Next, the method for producing the covered yarn of the present invention is described. FIG. 2 is a schematic diagram showing an example of the method for producing the covered yarn of the present invention.

In the present invention, a polyurethane elastic fiber is preferably used as the core yarn and covered with preferably the above-mentioned crimped yarn of a high strength fiber thereover as the sheath yarn.

In this two-ply covering, the above crimped yarn of a high strength fiber as the sheath yarn is used for either the top twist yarn or the bottom twist yarn, or both of them. When the above crimped yarn of a high strength fiber is used as the sheath yarn for either the top twist yarn or the bottom twist yarn, the other sheath yarn may be a known fiber filament, other than the high strength fibers, such as polyester and nylon fibers.

When covering, a commercial covering machine, and the like is preferably used.

FIG. 2 shows an example of the two-ply covering, and in FIG. 2, the polyurethane elastic fiber used as the core yarn 1 is actively fed by rotating yarn feed rollers 3, pre-drafted between feed rollers 4 and subsequently further drafted between the feed rollers 4 and delivery rollers 11. The draft ratio in this instance refers to the entire draft, that is, the draft between the yarn feed rollers 3 and the delivery rollers 11.

The sheath yarn 2 is taken up around an H bobbin 9 by a commercial high speed winder, then engaged with a lower spindle 5 and a upper spindle 7 as shown in FIG. 2, and wound around the core yarn when the spindles turn, thereby forming the covered yarn A.

The obtained covered yarn A is taken up around a cheese 14 by a take-up roller 13.

When producing a one-ply covered yarn, one H bobbin 9 is mounted on either one of the upper spindle 7 and the lower spindle 5 to wind the sheath yarn 2 around the core yarn 1 by spinning the spindles.

When covering the core yarn with the sheath yarn, the number of twists for covering of the sheath yarn may be suitably selected according to the fineness of the sheath yarn, but it is suitable that the value of the twist factor ($K_2$) represented by the expression (2) below be about 500 to 5,000, and preferably about 1,000 to 3,000. When a twist factor is below 500, the covering condition of the sheath yarn to the core yarn in the covered yarn is poor, and, when produced as a glove, the core yarn is exposed degrading the glove surface as well as reducing the properties such as cut wound resistance, adhesiveness to the coating resin, and the like. When a twist factor exceeds 5,000, the yarn breakage, and the like, easily occur during the covering step, hindering the passage of the step, and the sheath yarn is tightened up and fails to reflect the bulkiness originally found in the sheath yarn to the covered yarn. The above twisting is not particularly limited and may be one-ply covering or two-ply covering.

$$K_2 = T \times D^{1/2} \quad (2)$$

wherein T represents the number of twists for the covering (twists/m) and D represents the fineness (tex).

Additionally, for the two-ply covering, it is preferable that the top twist yarn be twisted for the covering in the opposite direction to the twist direction for the covering of the bottom twist yarn, in order to cancel the torque.

When covering the core yarn with the sheath yarn, it is suitable that the draft ratio of the core yarn be about 1.5 to 5.0, and preferably 2.0 to 4.0. When the draft ratio is below 1.5, the covering by the sheath yarn during the covering step becomes difficult, whereas when the draft ratio exceeds 5.0, the yarn breakage is likely to occur during the covering step, reducing the productivity.

Particularly when a polyurethane elastic fiber is used, the polyurethane elastic fiber, if exposed to the surface of the covered yarn, causes reduced core yarn physical properties due to the swelling and dissolution when a solvent type coating material is used. Further, the polyurethane elastic fiber has poor heat resistance and hence deteriorates and decomposes by heat at an early stage while the glove is used, thus reducing the adhesiveness to the coating material which may cause the peel off of the coating material.

The glove also receives the force which peels the coating material on the surface while in use. For this reason, when the number of winding of the sheath yarn around the core yarn is excessive, the bulkiness of the sheath yarn is not reflected to the covered yarn, and the coating material does not adhere to the covered yarn because the coating material hardly goes into the gaps of the sheath yarn. When the adhesiveness between the covered yarn and the coating material is poor, the coating material peels off the surface of glove and the glove breaks without reinforcement, hence reducing the durability.

In the present invention, a glove is fabricated by knitting a knitted fabric from the above covered yarn. The glove is manufactured using a commercial computer glove knitting machines SFG or STJ (SHIMA SEIKI MFG., LTD.).

Further, the fabricated glove is put on a hand-shaped mold, or the like, impregnated with a rubber or resin coating material and dried, or a rubber or resin is caused to be attached and adhere to the glove, thereby allowing the coating material to coat the surface of glove. Thus, the glove, having abrasion resistance and waterproofing properties in addition to the properties such as heat resistance and cut wound resistance, and hardly slips when holding an article, can be fabricated.

Examples of the coating material include polyurethane resins, vinyl chloride resins, latex, synthetic rubbers and natural rubbers, and the like. Of these, polyurethane resins are preferable in light of good adhesiveness to polyurethane elastic fibers as well as good flexibility and waterproofing properties of the glove after coating and good abrasion resistance of the coating film. Of these, a solvent type polyurethane is preferable because it is capable of forming a strong film than an aqueous dispersion.

The coating material may be used in a conventionally known method, and examples include a wet film forming polyurethane resin dissolved in a DMF (N,N-dimethylformamide) solvent, and a polyurethane resin for dry processing dissolved in a xylene/IPA mixed solvent, and the like. Of these, a wet film forming polyurethane resin is preferable.

The coating material may be allowed to coat at least a part of the glove surface. The coating material may be caused to adhere to almost the throughout the palm side and the finger tip areas, to the entire surface including the back side of the hand, or only to the finger areas, to a predetermined finger tip(s), or any other forms may be acceptable.

EXAMPLES

Hereinafter, the present invention is described in further detail with reference to Examples. However, the present invention is not limited to these Examples.

Each physical property was evaluated according to the following methods.

[Fineness]

Measurement was carried out according to JIS L 1013: 2010 Testing methods for man-made filament yarns 8.3 B method (simplified method).

[Tensile Strength]

The tensile strength was measured according to JIS L 1013: 2010 Testing methods for man-made filament yarns 8.5.

[Stretchiness]

The shrinkage/elongation ratio was measured according to JIS L 1013:2010 Testing methods for man-made filament yarns 8.11 A method. As the pretreatment before the measurement, a measurement sample in reeling form was subjected to hot water treatment at 90° C. for 20 minutes while wrapped in a gauze, and dried in the air at room temperature.

[Bulkiness]

As the pretreatment before the measurement, a measurement sample in reeling form was subjected to hot water treatment at 90° C. for 20 minutes while wrapped in a gauze, and dried in the air at room temperature to prepare a standard sample, which was then measured for the degree of bulkiness ($cm^3/g$) and the bulk compression modulus (%) according to JIS L 1013:2010 Testing methods for man-made filament yarns 8.16 A method.

[Cut Wound Resistance (Cut Resistance)]

Measurement was carried out according to JIS T 8052: 2005 Protective clothing—Mechanical properties—Determination of resistance to cutting by sharp objects.

[Adhesiveness of Coating Material]

A test sample was collected from the coated area of the glove and flexed 500 times while applying a load of 0.5 kg, according to JIS K 6404-6:1999 Testing methods for rubber- or plastics-coated fabrics—Part 6: Crease-flex test, and those with no peel of the coated area by the visual evaluation was defined as passed and all others were defined as failed. The test sample was collected only in the longitudinal direction.

[Fitting Evaluation of Glove]

The fitting test was carried out by 5 subjects. According to EN 420:2003 Protective gloves—General requirements and test methods 5.2, the gloves, to which all subjects gave the performance evaluation Level 5 in terms of dexterity and 3 or more out of 5 subjects gave the "good sense of fitting" in the sensory evaluation, were considered passed, and all others were considered failed.

Example 1

Using a filament yarn of polyparaphenylene terephthalamide fiber (hereinafter referred to as PPTA) (manufactured by DuPont-Toray Co., Ltd., trade name "Kevlar," registered trademark) having a total fineness of 440 dtex, a monofilament fineness of 1.7 dtex, a number of filaments of 267, a tensile strength of 2.03 N/tex, and a water content of 7%, continuous false twisting was carried out under the processing conditions of false twisting rate: 60 m/min, false twisting temperature (dry heat): 500° C., number t of false twists: 1,150 twists/m, false twist twisting direction: S direction, and number of spindle revolution: 69,000 rpm, thereby obtaining a crimped yarn (a twist factor ($K_1$)=7,628) of PPTA filaments having a strength retention of 40%. The characteristic of the obtained crimped yarn are shown in Table 1.

Using the covering step shown in FIG. 2, as a bottom twist yarn of a sheath yarn, a nylon fiber wooly finished yarn (twist direction: Z twist) having a fineness of 156 dtex was spirally wound around a core yarn composed of a polyurethane elastic fiber (manufactured by Toray Opelontex Co., Ltd., trade name "LYCRA," registered trademark) having a fineness of 117 dtex and a fracture elongation of 530%, and further, as a top twist yarn of the sheath yarn, the crimped yarn of the para-aramid fiber obtained in the above was spirally wound in the opposite direction to the nylon fiber wooly finished yarn, thereby obtaining a covered yarn under the following processing conditions.

Number of spindle revolution: 5,000 rpm
Draft of core yarn: 3.0 times
Number T of twists for covering and twist direction of bottom twist yarn of the sheath yarn: 700 twists/m, Z direction, twist factor ($K_2$)=2,764
Number T of twists for covering and twist direction of top twist yarn of the sheath yarn: 300 twists/m, S direction, twist factor (K2)=1,990

A single stand of the obtained covered yarn was fed to a 13-gauge glove knitting machine (SHIMA SEIKI MFG., LTD.) to knit a glove having a weight of 18 g/piece and a weight at the palm area of 360 g/m$^2$. The glove was soft, voluminously textured, very stretchy and fitted well, and had good burn resistance and heat resistance as well as knife-cutting resistance (cutting force: 6.5 N).

CRISVON MP105 (manufactured by DIC Corporation), a wet porous layer-forming urethane resin dissolved in DMF, was diluted with DMF to a concentration of 11% and used as a coating material. The knitted glove, while put on a hand-shaped mold, was immersed in the above urethane solution and pulled up. Subsequently, the glove was immersed in hot water at 50° C. for 60 minutes, and the solvent DMF of resin solution was replaced with water. Then, the glove was pulled out of water, dried and removed from the hand-shaped mold, thereby fabricating a back-uncoated glove with the coating material applied only to one side having a weight of 21 g/piece and an amount of the adhered resin on the palm area of 105 g/m$^2$.

The glove had good adhesiveness of the coating material and was suitable to be a high safety work glove used for the coating work of automobile and aluminum building materials due to good grip (slip proofing) properties.

Example 2

A glove was fabricated in exactly the same manner as in Example 1, except that a PPTA filament yarn used had a total fineness of 440 dtex, a monofilament fineness of 3.3 dtex, a number of filaments of 134, a tensile strength of 2.03 N/tex, and a water content of 7%. The crimped yarn obtained at this time had a strength retention of 38%. The characteristics of the obtained crimped yarn are shown in Table 1.

The obtained glove had a weight of 18.5 g/piece and a weight at the palm area of 350 g/m$^2$, and was soft, voluminously textured, very stretchy and fitted well, and had good burn resistance and heat resistance as well as knife-cutting resistance (cutting force: 8.4 N).

The glove coated with the urethane resin in the same manner as in Example 1 had a weight of 21.5 g/piece and an amount of the adhered resin on the palm area of 115 g/m$^2$, was a back-uncoated glove with the coating material applied only to one side, with good adhesiveness of the coating material, and was suitable to be a high safety work glove used for the coating work of automobile and aluminum building materials due to good grip (slip proofing) properties.

Comparative Example 1

A glove was fabricated in the same manner as in Example 1, except that the method for processing a crimped yarn to be described later was employed.

Using the same PPTA filament yarn as in Example 1, an S twist was applied to this yarn using a double twister as the twisting step, thereby obtaining a twisted yarn having a number of twists t; 1,170 (twists/m). The twist factor ($K_1$) at this time was 7,760 and calculated by the following expression.

$$K_1 = t \times D^{1/2}$$

wherein t represents the number of twists (twists/m) during the twisting step and D represents fineness (tex).

The obtained twisted yarn was placed in a saturated water vapor treatment apparatus, which was to be the wet heat treatment step, to carry out saturated water vapor treatment (wet heat) at 200° C. for 15 minutes to set the twist. After cooling, the reverse twist was applied using a double twister, which was to be the untwisting step, to untwist the yarn until a number of twists of nearly 0 was attained, thereby obtaining a crimped yarn of PPTA filament yarn having a strength retention of 36%. The characteristics of the obtained crimped yarn are shown in Table 1.

The obtained glove had a weight of 18 g/piece and a weight at the palm area of 340 g/m$^2$, and good burn resistance, heat resistance and knife-cutting resistance (cutting force: 6.0 N), but lacked softness, voluminous texture and stretchiness and was ill-fitted.

Also, the glove coated in the same manner as in Example 1 was a back-uncoated glove with the coating material applied only to one side having a weight of 23 g/piece and an amount of the adhered resin on the palm area of 130 g/m$^2$ and had poor adhesiveness of the coating material, which easily peeled off.

Example 3

A crimped yarn of PPTA filaments was obtained by carrying out the continuous false twisting under the same processing conditions as in Example 1 using the same PPTA filament yarn as that used in Example 1 having a total fineness of 440 dtex, a monofilament fineness of 1.7 dtex, a number of filaments of 134, a tensile strength of 2.03 N/tex, and a water content of 7%, except that the false twisting temperature (dry heat) was 470° C. The characteristics of the obtained crimped yarn are shown in Table 1.

The obtained glove had a weight of 18 g/piece and a weight at the palm area of 356 g/m$^2$, and was soft, voluminously textured, very stretchy and fitted well, and had good burn resistance and heat resistance as well as knife-cutting resistance (cutting force: 6.4 N).

Then, a back-uncoated glove with the coating material applied only to one side having a weight of 21.5 g/piece and an amount of the adhered resin on the palm area of 110 g/m$^2$ was fabricated in the same manner as in Example 1. The obtained glove had good adhesiveness of the coating material and was suitable to be a high safety work glove used for the coating work of automobile and aluminum building materials due to good grip (slip proofing) properties.

Comparative Example 2

A crimped yarn of PPTA filaments was obtained by carrying out the typical false twisting under the same processing conditions as in Example 1 using the same PPTA filament yarn as that used in Example 1 having a total fineness of 440 dtex, a monofilament fineness of 1.7 dtex, a number of filaments of 134, a tensile strength of 2.03 N/tex, and a water content of 7%, except that the false twisting temperature (dry heat) was 350° C. The characteristics of the obtained crimped yarn are shown in Table 1.

The obtained glove had a weight of 17.5 g/piece and a weight at the palm area of 340 g/m$^2$, and good burn resistance and heat resistance, but was more or less easily cut with a knife (cutting force: 5.2 N), lacking softness, voluminous texture and stretchiness and was ill-fitted.

Also, the glove coated in the same manner as in Example 1 was a back-uncoated glove with the coating material applied only to one side, having a weight of 21 g/piece and an amount of the adhered resin on the palm area of 130 g/m$^2$ and had poor adhesiveness of the coating material, which easily peeled off.

TABLE 1

| Properties of crimped yarns | | | | | | | |
|---|---|---|---|---|---|---|---|
| | | | Heat treatment | Bulkiness | | Stretchiness | Strength retention |
| | Total fineness (dtex) | Monofilament fineness (dtex) | during crimping Type/Temp (° C.) | Degree of bulkiness ($cm^3/g$) | Bulk compression modulus (%) | Shrinkage/ elongation ratio (%) | of crimped yarn (%) |
| Example 1 | 440 | 1.7 | Dry heat/500 | 48 | 85 | 22 | 40 |
| Example 2 | 440 | 3.3 | Dry heat/500 | 67 | 87 | 35 | 38 |
| Comparative Example 1 | 440 | 1.7 | Wet heat/200 | 30 | 76 | 17 | 36 |
| Example 3 | 440 | 1.7 | Dry heat/470 | 46 | 83 | 21 | 46 |
| Comparative Example 2 | 440 | 1.7 | Dry heat/350 | 22 | 74 | 11 | 64 |

Table 2 collectively shows the composition of covered yarns and the evaluation results of glove properties.

TABLE 2

| Covered yarns and glove properties | | | | | | | |
|---|---|---|---|---|---|---|---|
| | Composition of covered yarn | | | | Glove properties | | |
| | | Sheath yarn | | Number | Cutting force | | |
| | Core yarn | Bottom twist yarn | Top twist yarn | of covering (plies) | before coating (N) | Adhesiveness of coating material | Fitting evaluation of glove |
| Example | Polyurethane 117dtex | Nylon 156dtex | PPTA 440dtex | 2 | 6.5 | Passed | Passed |
| Example 2 | Polyurethane 117dtex | Nylon 156dtex | PPTA 440dtex | 2 | 8.4 | Passed | Passed |
| Comparative Example 1 | Polyurethane 117dtex | Nylon 156dtex | PPTA 440dtex | 2 | 6.0 | Failed | Failed |
| Example 3 | Polyurethane 117dtex | Nylon 156dtex | PPTA 440dtex | 2 | 6.4 | Passed | Passed |
| Comparative Example 2 | Polyurethane 117dtex | Nylon 156dtex | PPTA 440dtex | 2 | 5.2 | Failed | Failed |

PPTA: Polyparaphenylene terephthalamide

INDUSTRIAL APPLICABILITY

The glove of the present invention is useful to be a work glove for the fishing industry, agricultural industry, food industry, medical service, high-tech industry, and the like, or for sports glove.

REFERENCE SIGNS LIST

A: Covered yarn
1: Core yarn
2: Sheath yarn
3: Rotating yarn feed roller
4: Feed roller
5: Lower spindle
6: Lower belt
7: Upper spindle
8: Upper belt
9: H Bobbin
10: Snell guide
11: Delivery roller
12: Guide bar
13: Take-up roller
14: Cheese

The invention claimed is:

1. A glove knitted from a covered yarn obtained by winding a sheath yarn around a core yarn, wherein the sheath yarn is made of a high strength fiber having, as a property of a raw yarn, a tensile strength of 1.75 N/tex or more as measured according to JIS L 1013 8.5, and coated with a rubber or resin coating material on at least a part of a surface thereof, wherein the sheath yarn is a crimped yarn having bulkiness and stretchiness which simultaneously satisfy the following (1) to (3):

(1) a degree of bulkiness of 40 $cm^3/g$ or more, (2) a bulk compression modulus of 80% or more, and (3) a shrinkage/elongation ratio of 20% or more.

2. The glove according to claim 1, wherein the degree of bulkiness is 40 to 80 $cm^3/g$.

3. The glove according to claim 1, wherein the bulk compression modulus is 80 to 95%.

4. The glove according to claim 1, wherein the shrinkage/elongation ratio is 20 to 70%.

5. The glove according to claim 1, wherein the crimped yarn has a strength retention of 25% or more.

6. The glove according to claim 1, wherein the sheath yarn is a crimped yarn of a para-aramid fiber.

7. The glove according to claim 6, wherein the crimped yarn of a para-aramid fiber is obtained by twisting the fiber, then heat-setting the twisted fiber by dry heat treatment under a heater temperature of 470 to 550° C., and subsequently untwisting the twist.

8. The glove according to claim 1, wherein the core yarn is an elastic fiber.

9. The glove according to claim 1, wherein the covered yarn has a draft ratio of the core yarn of 1.5 to 5.0 and has a twist factor ($K_2$) for covering of the sheath yarn of 500 to 5,000, wherein $K_2=T\times D^{1/2}$, wherein T represents a number of twists (twists/m) for the covering, and wherein D represents fineness (tex).

10. The glove according to claim 1, wherein the coating material is a polyurethane resin.

11. The glove according to claim 10, wherein the polyurethane resin is formed by a wet film forming method.

12. The glove according to claim 2, wherein the bulk compression modulus is 80 to 95%.

* * * * *